United States Patent [19]

Mitrovich

[11] 4,203,680

[45] May 20, 1980

[54] HIGH-SPEED PRINTER WITH SELF-ADJUSTING CABLE PRELOAD MECHANISM

[75] Inventor: Svetislav Mitrovich, Dallas, Tex.

[73] Assignee: Xerox Corporation, Stamford, Conn.

[21] Appl. No.: 922,891

[22] Filed: Jul. 10, 1978

[51] Int. Cl.[2] ..... B41J 19/00

[52] U.S. Cl. ..... 400/335; 400/320; 400/144.2; 400/322

[58] Field of Search ..... 400/144.2, 144.3, 157.2, 400/320, 320.1, 335, 336, 336.1, 903, 322; 74/89.22, 230.01, 230.05

[56] References Cited

U.S. PATENT DOCUMENTS

| | | | |
|---|---|---|---|
| 3,872,960 | 3/1975 | Gabor | 400/335 |
| 3,954,163 | 5/1976 | Gabor | 400/157.2 X |
| 4,116,568 | 9/1978 | Suzuki et al. | 400/320 |

*Primary Examiner*—Ernest T. Wright, Jr.

[57] ABSTRACT

A high-speed printer in which the carriage carrying a print wheel is coupled to a servo controlled driving motor having intermittent motion. The motor drives a helically grooved pulley, which has attached to it left and right cable segments. The other ends of the cable segments are attached to the movable carriage. A cable preload spring and friction pulley snubber combination maintains cable tension relatively constant. The snubber provides a tight cable system during normal carriage acceleration and deceleration. The preload spring allows for tension correction when the cable suffers from long-term stretching due to constructional stretching, that is, the normal tendency of wound cables to stretch due to seating of individual wires in the strand.

1 Claim, 4 Drawing Figures

HIGH-SPEED PRINTER WITH SELF-ADJUSTING CABLE PRELOAD MECHANISM

BRIEF SUMMARY OF THE INVENTION

The present invention is directed to a high-speed printer with a drift compensated cable for driving a carriage.

In printing devices such as the Xerox 800 Electronic Typing System, it is necessary to convert the rotary motion of a drive shaft of a motor to linear carriage motion. One solution is a lead screw. This must be made heavy to avoid windup and thus presents a high inertia to the system.

Cables and belts have also been used. These are normally unsuitable when the carriage is intermittently moved with high acceleration and deceleration because of the resultant mechanical drift or cable stretching, which causes misregistration.

It is, therefore, an object of this invention to provide an improved drift and cable stretching compensated cable system for use in driving the carriage of a high-speed printer.

In accordance with the above object, there is provided a high-speed printer for printing on a record medium comprising a movable carriage for carrying a printing unit along a predetermined line of printing with respect to the record medium. Means for intermittently transporting the carriage and printing unit to stationary printing positions along the line of printing is provided. The carriage is movable from a center position to extreme left and right positions. The transporting means includes a motor. Pulley means are driven by the motor. Cable means couple the pulley means to the carriage. The cable means are divided into two segments of about equal length, each of the segments having an end affixed to the pulley means. The pulley means have peripheral wrapping surfaces for wrapping equal lengths of the two segments in opposite directions on said surfaces when the carriage is in the center position. The pulley means respectively accommodate a substantially greater length of one segment than the other when the carriage is in one of the extreme positions.

DETAILED DESCRIPTION OF THE PREFERRED EMBODIMENT

Figure 1:
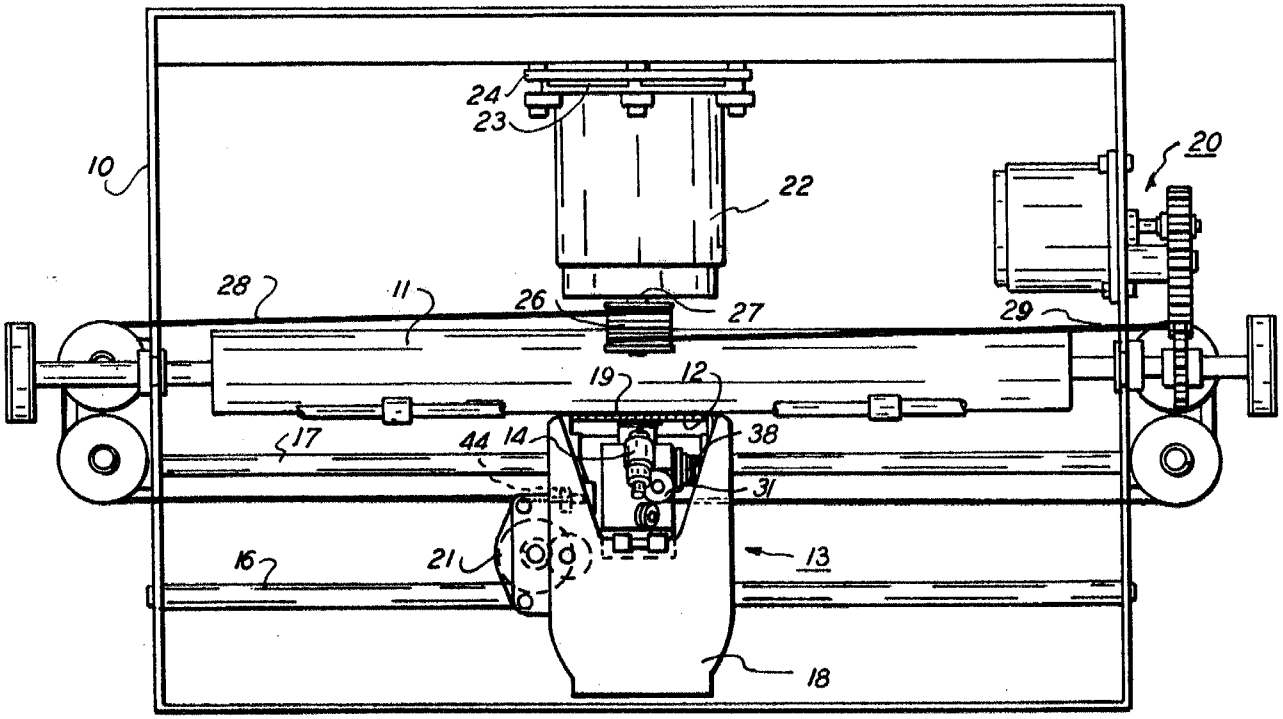
FIG. 1 is a plan view of a printer embodying the present invention.

Referring now to FIG. 1, an overall plan view of the printer of the present invention is illustrated, which is contained within a frame 10. The printer includes a platen or roller 11, which carries the paper or record medium. The record medium is printed upon by a print wheel 12 carried by carriage 13. Print wheel 12 is of the type having a number of radially extending spokes with the type element being on the periphery of the spokes. Printing occurs when a hammer 14 impacts the particular type element, which has been previously positioned. Details of print wheel 12 and its operation are disclosed and claimed in U.S. Pat. No. 3,954,163, issued May 4, 1976, to Andrew Gabor and entitled "High Speed Printer With Intermittent Print Wheel and Carriage Movement".

Print wheel 12 is carried along a predetermined line of printing along platen 11 by carriage 13. The carriage 13 is mounted for linear movement on rods 16 and 17. The carriage 13 includes a ribbon cartridge 18, which has an inked ribbon 19 driven by stepping motor 21. Vertical paper feed assembly 20 is also provided.

Carriage 13 is intermittently transported to various stationary positions along the line of printing by a motor 22. Motor 22 is part of a servo control system; mounted on its shaft 27 is a rotary disc 23 adjacent a fixed disc 24. As discussed in the above U.S. Pat. No. 3,954,163, a series of radial parallel metal conductors are present on the discs and provide position signals for the servo system.

A pulley 26 is also mounted on shaft 27. Motor 22 drives carriage 13 by left cable segment 28 and right cable segment 29. It is preferred to use doubled or two cables for each of cable segments 28 and 29 as shown in the Figures. The motor 22 in conjunction with the pulley 26 and cable segments 28, 29 serves to transport the carriage 13 from a center position in which it is shown to extreme left and right printing positions.

Figure 2:
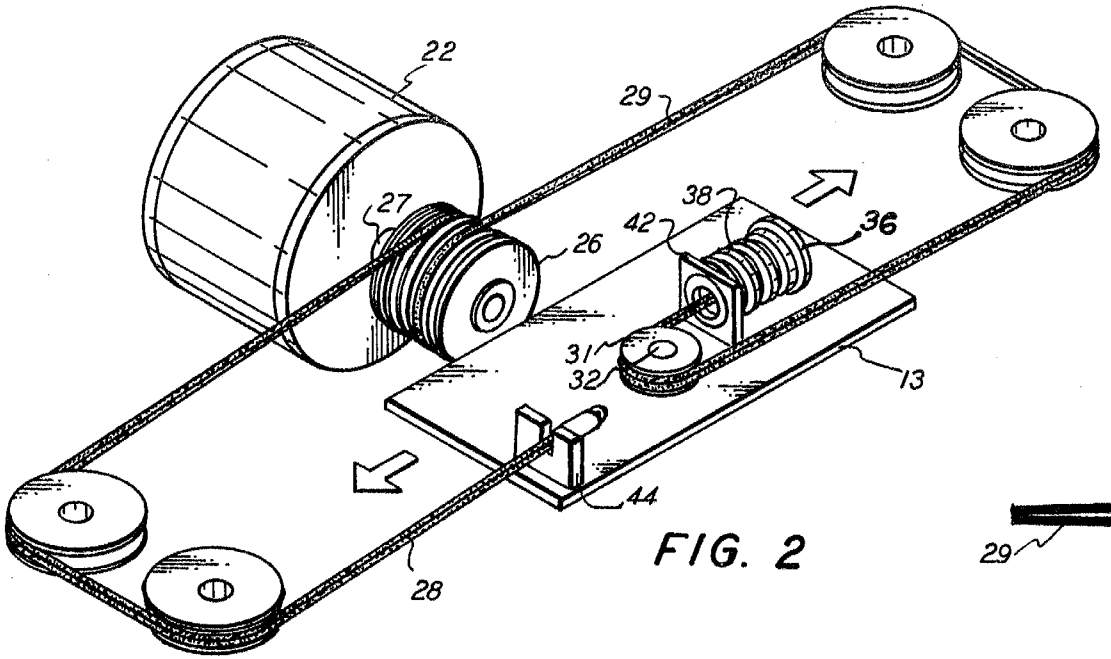
FIG. 2 is a perspective view of the cable drive portion of FIG. 1.
Figure 4:
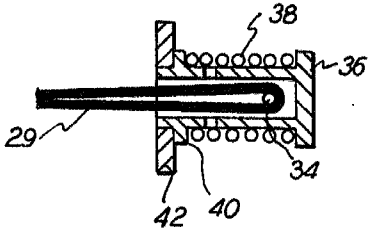
FIG. 4 is an enlarged cross-sectional view of a portion of FIG. 2.

Referring now to FIG. 2, the cable segments 28, 29 are coupled to carriage 13 through a friction pulley arrangement 31 mounted on shaft 32, which in turn is mounted on carriage 13. Cable segment 29 is looped over cable anchor pin 34 mounted in end cap 36. End cap 36 is resiliently mounted to carriage 13 by preload spring 38, spring guide 40 and plate 42, which is fixed to carriage 13. Friction pulley 31 acts as a snubber for cable 29. Normally, friction pulley 31 provides a stiff cable system, which will not allow drifting under normal printer operation. However, should long-term stretching of the cable segments 28, 29 occur due to constructional stretching, that is, the normal tendency of wound cables to stretch due to seating of individual wires in the strand, preload spring 38 will overcome the friction pulley 31 snubbing force and will pull the cable segments 28, 29 taut. It can be seen then that the combination of friction pulley 31 and preload spring 38 provides a desirably stiff cable system for rapid, accurate cycling and yet provides the resilience required for longer term cable tension adjustment. The friction may result from restricting the movement between the cable segment 29 and pulley 31 or between the pulley 31 and shaft 32 by selection of suitable materials as is well known in the art.

As shown in FIG. 2, cable segment 28 is fixed to carriage 13 by fastening to plate 44 by any conventional method. Here the cable segment 28 is simply clamped together, and the clamp is held in place by plate 44.

Figure 3:
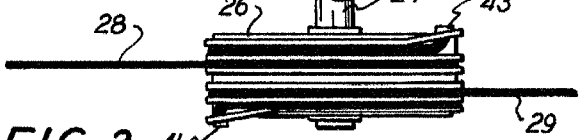
FIG. 3 is an enlarged plan view of the pulley of FIG. 2.

As is more clearly shown in FIG. 3, pulley 26 has a helically grooved rim around which cable segments 28, 29 are wound. The end of cable segment 29 is affixed to the rim at point 41 as shown in FIG. 3, and the end of cable segment 28 is affixed to the rim at point 43. The cable segments 28, 29, as illustrated with the carriage 13 in its center position, has approximately equal lengths of each segment 28, 29 in the grooves of the pulley 26. As the carriage 13 is driven, as illustrated by the arrows in FIG. 2, to either the left or right extreme positions, a substantially greater length of one segment 28, 29 than the other will be accommodated or wrapped about pulley 26.

It is preferred to use a cable doubled on two cables for each of cable segments 28 and 29 to allow for more flexible design parameters in, for example, carriage weight. Also, the friction pulley 31 to spring preload 38 forces ratio can be altered by varying the amount of cable wrap around the friction pulley 31 from the 180° cable wrap shown in the Figures.

What is claimed is:

1. A carriage driving mechanism for a high-speed printer comprising:

a movable carriage for carrying a printing unit along a predetermined line of printing, said carriage including friction pulley means mounted for rotation on said carriage and resilient means for resiliently connecting a cable to said carriage;

means for intermittently transporting said carriage and said printing unit to stationary printing positions along said line of printing, said carriage being movable from a center position to extreme left and right positions, such transporting means including a motor and a second pulley means driven by said motor;

a frame for accommodating said carriage and motor;

cable segments coupling said second pulley means to said carriage, each of said cable segments having an end affixed to said second pulley means, said second pulley means having peripheral wrapping surfaces for wrapping approximately equal lengths of said cable segments on said surfaces when said carriage is in said center position, and for respectively accommodating a substantially greater length of one cable segment than the other when said carriage is in one of said extreme positions, said cable segments being respectively wrapped around said second pulley means in opposite directions, the other ends of said cable segments being affixed to said carriage, at least one of said segments being wrapped around said friction pulley means and being attached to said resilient means.

* * * * *